US007765608B2

(12) United States Patent
Durocher et al.

(10) Patent No.: US 7,765,608 B2
(45) Date of Patent: Aug. 3, 2010

(54) FACE GUARD FOR A SPORTS HELMET

(75) Inventors: Jacques Durocher, St-Jérôme (CA); Jean-François Laperrière, St-Sauveur (CA); Marie-Claude Généreux, Ste-Thérèse (CA)

(73) Assignee: Bauer Hockey, Inc., Greenland, NH (US)

( * ) Notice: Subject to any disclaimer, the term of this patent is extended or adjusted under 35 U.S.C. 154(b) by 1041 days.

(21) Appl. No.: 11/211,668

(22) Filed: Aug. 26, 2005

(65) Prior Publication Data

US 2007/0044193 A1 Mar. 1, 2007

(51) Int. Cl.
*A42B 3/20* (2006.01)

(52) U.S. Cl. ..... 2/9; 2/424

(58) Field of Classification Search ..... 2/424, 2/9, 410, 425, 421, 455, 173, 909
See application file for complete search history.

(56) References Cited

U.S. PATENT DOCUMENTS

| | | | | |
|---|---|---|---|---|
| RE25,176 | E | 5/1962 | Novak | |
| 4,631,758 | A * | 12/1986 | Newman et al. | 2/424 |
| 4,933,993 | A | 6/1990 | McClelland | |
| 5,249,347 | A | 10/1993 | Martinitz | |
| 5,661,849 | A | 9/1997 | Hicks | |
| 5,806,088 | A * | 9/1998 | Zide et al. | 2/9 |
| 6,338,165 | B1 * | 1/2002 | Biondich | 2/424 |
| 6,763,524 | B2 | 7/2004 | Halstead et al. | |
| 7,406,966 | B2 * | 8/2008 | Wondka | 128/207.18 |
| 2003/0070201 | A1 | 4/2003 | McClelland | |
| 2006/0053520 | A1 | 3/2006 | Bologna | |

FOREIGN PATENT DOCUMENTS

| | | |
|---|---|---|
| CA | 2228336 | 7/1999 |
| CA | 2 508 055 A1 | 11/2005 |

* cited by examiner

*Primary Examiner*—Tejash Patel

(57) ABSTRACT

A face guard for a sports helmet, comprising a plurality of wires arranged as a grid and wherein at least one of the wires has a cross-section with a periphery having a first maximal dimension in a first direction and a second maximal dimension in a second direction intersecting the first direction, the second maximal dimension being less than the first maximal dimension. Each of the at least one of the wires may have an elliptical cross-section with a major axis and a minor axis, wherein a ratio of the minor axis to the major axis may be between 0.2 and 0.9. Each of the at least one of the wires may have a portion to be at least partially located within a field of view of a wearer wearing the face guard.

13 Claims, 6 Drawing Sheets

FACE GUARD FOR A SPORTS HELMET

FIELD OF THE INVENTION

The present invention relates to a face guard for a sports helmet.

BACKGROUND OF THE INVENTION

A protective helmet is often used to protect a wearer's head during practice of a sport such as hockey, lacrosse, ringette, football and baseball. A protective helmet sometimes comprises a face guard for protecting a wearer's face against impact with an object such as a sports implement (e.g. a stick, a bat, etc.), a puck, a ball, or any other object involved in a given sport.

One type of face guard is a wire face guard, which includes a series of horizontal and vertical wires defining a protective grid extending in front of the wearer's face. The wires are dimensioned and configured so as to prevent an object from passing through the protective grid and impacting the wearer's face. For instance, in hockey, the wires are dimensioned and configured so as to prevent a hockey stick or puck from passing through the protective grid and impacting the wearer's face.

Wires of existing face guards are typically made of metal such as steel and have a circular cross-section with a diameter sufficiently large to meet strength and impact resistance requirements established by standards organizations. However, this requirement placed on the diameter of wires negatively affects visibility of the wearer since it results in wires being more obstructive to vision.

There is therefore a need for a face guard providing improvements in terms of visibility of the wearer while still providing sufficient strength and impact resistance.

SUMMARY OF THE INVENTION

As embodied and broadly described therein, the invention provides a face guard for a sports helmet, comprising a plurality of wires arranged as a grid and wherein at least one of the wires has a cross-section with a periphery having a first maximal dimension in a first direction and a second maximal dimension in a second direction intersecting the first direction, the second maximal dimension being less than the first maximal dimension.

The invention also provides a face guard for a sports helmet, comprising a plurality of wires arranged as a grid, wherein at least one of the wires has an elliptical cross-section having a major axis and a minor axis with a ratio of the minor axis to the major axis being between 0.2 and 0.9, and wherein each of the at least one of the wires has a portion to be at least partially located within a field of view of a wearer wearing the face guard.

The invention further provides a face guard for a sports helmet, comprising a plurality of wires arranged as a curved grid having a concave side for facing a face of a wearer. The plurality of wires comprises first, second and third wires intersecting fourth, fifth and sixth wires, each of the first, second, third, fourth, fifth and sixth wires having a portion to be at least partially located within a field of view of the wearer, and each of the first, second, third, fourth, fifth and sixth wires having a cross-section with a periphery having a respective first maximal dimension in a respective first direction and a respective second maximal dimension in a respective second direction intersecting the first direction, the second maximal dimension being less than the first maximal dimension.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of specific embodiments of the present invention is provided herein below, by way of example only, with reference to the accompanying drawings, in which.

Figure 2:
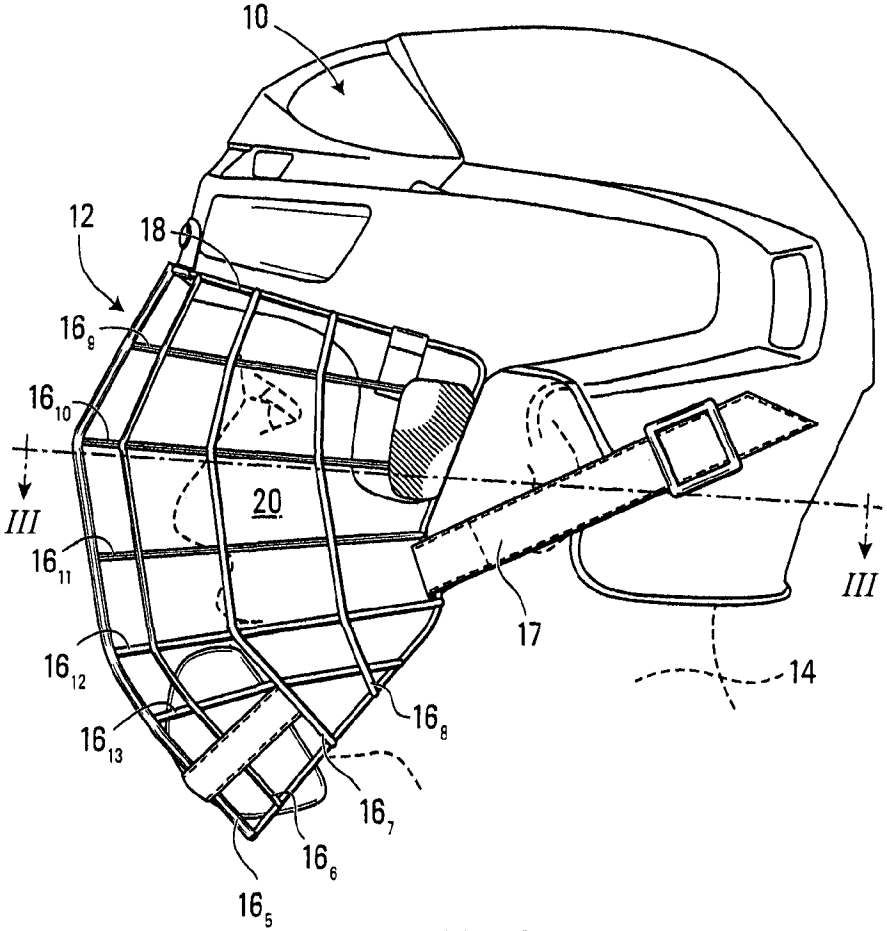
FIG. 2 is a right side elevational view of the helmet and face guard of FIG. 1.
Figure 1:
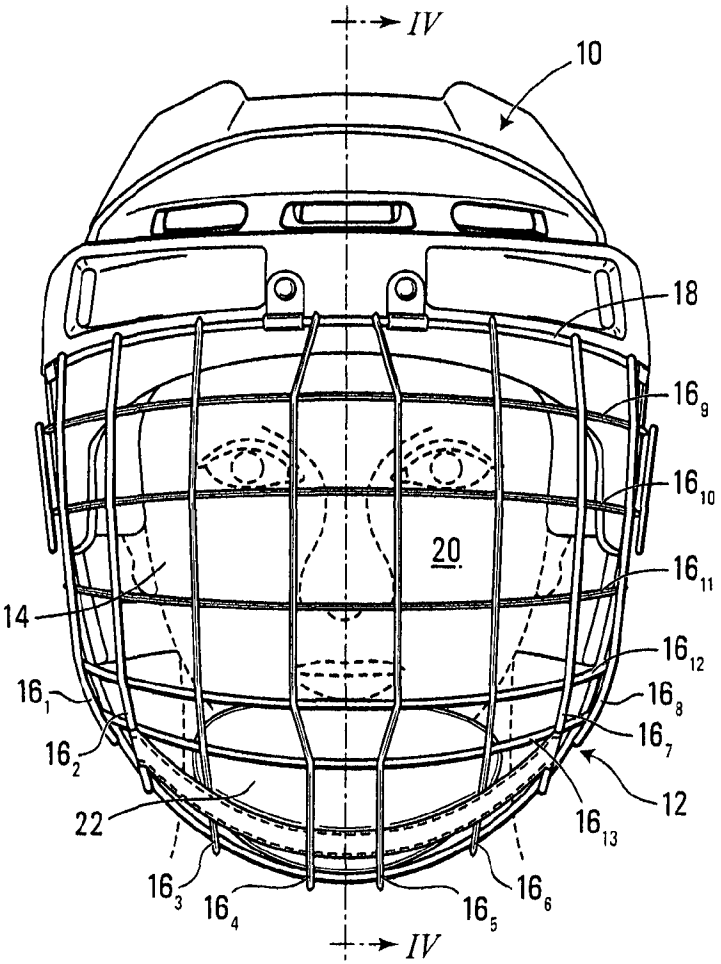
FIG. 1 is a front elevational view of a helmet having a face guard in accordance with an embodiment of the present invention.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

FIGS. 1 to 4 show a hockey helmet 10 to which is coupled a face guard 12 in accordance with an embodiment of the invention. The face guard 12 is for protecting the face of a wearer 14 against impact with a hockey stick or puck when the wearer 14 plays hockey. Although in the embodiment, the face guard 12 is described in relation to hockey, it is to be understood that the face guard 12 may be adapted for use in other sports requiring face protection such as lacrosse, ringette, football, and baseball. For example, the face guard 12 can be used on a baseball helmet of a catcher with some minor modifications that will be apparent to a person skilled in the art.

The face guard 12 comprises a plurality of wires $\mathbf{16}_1$-$\mathbf{16}_{13}$ arranged as a grid and coupled to a contour wire 18. The grid may be a curved grid having a concave side for facing the face of the wearer 14. The wires $\mathbf{16}_1$-$\mathbf{16}_8$ are generally vertical, the wires $\mathbf{16}_9$-$\mathbf{16}_{13}$ are generally horizontal, and together they define a plurality of apertures 20, each sized and configured to prevent a hockey stick or a hockey puck from impacting the face of the wearer 14. The face guard 12 may be pivotally coupled to the hockey helmet 10 at an upper portion of the contour wire 18 and coupled to the hockey helmet 10 via adjustable straps 17. The face guard 12 may also be provided with a chin pad 22 for engaging the chin of the wearer 14 so as to fit comfortably over the face of the wearer 14.

The wires $\mathbf{16}_1$-$\mathbf{16}_{13}$ and the contour wire 18 may be made of steel (e.g. SAE grade 1006 to 1012) and may be interconnected to each other via welding. In other embodiments, the wires $\mathbf{16}_1$-$\mathbf{16}_{13}$ and the contour wire 18 may be made of any other suitable material and interconnected to each other via any other suitable fastening means. The wires $\mathbf{16}_1$-$\mathbf{16}_{13}$ and the contour wire 18 are formed, for example, by bending, to provide a concave side to the face guard 12 such that the face guard 12 is spaced apart from the face of the wearer 14.

As described below, the wires $\mathbf{16}_1$-$\mathbf{16}_{13}$ are configured and dimensioned so as to provide optimal visibility to the wearer 14, while providing sufficient strength and rigidity for impact resistance.

The wires $\mathbf{16}_1$, $\mathbf{16}_2$, $\mathbf{16}_7$, $\mathbf{16}_8$, $\mathbf{16}_{12}$ and $\mathbf{16}_{13}$ and the contour wire 18 each has a cross-section with a circular periphery.

Figure 3:
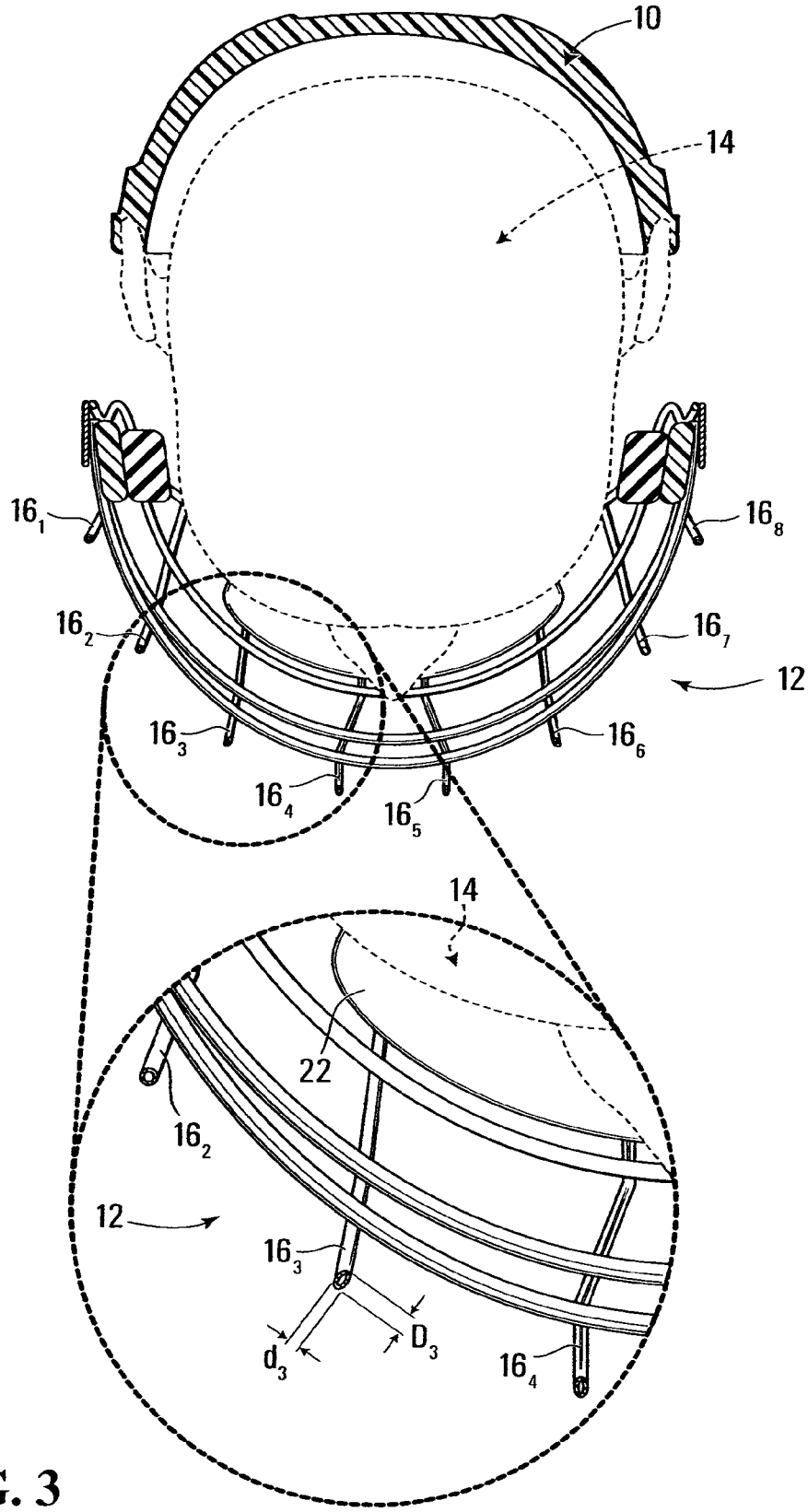
FIG. 3 is a cross-sectional plan view of the helmet and face guard of FIG. 1, taken along line III-III of FIG. 1.
Figure 4:
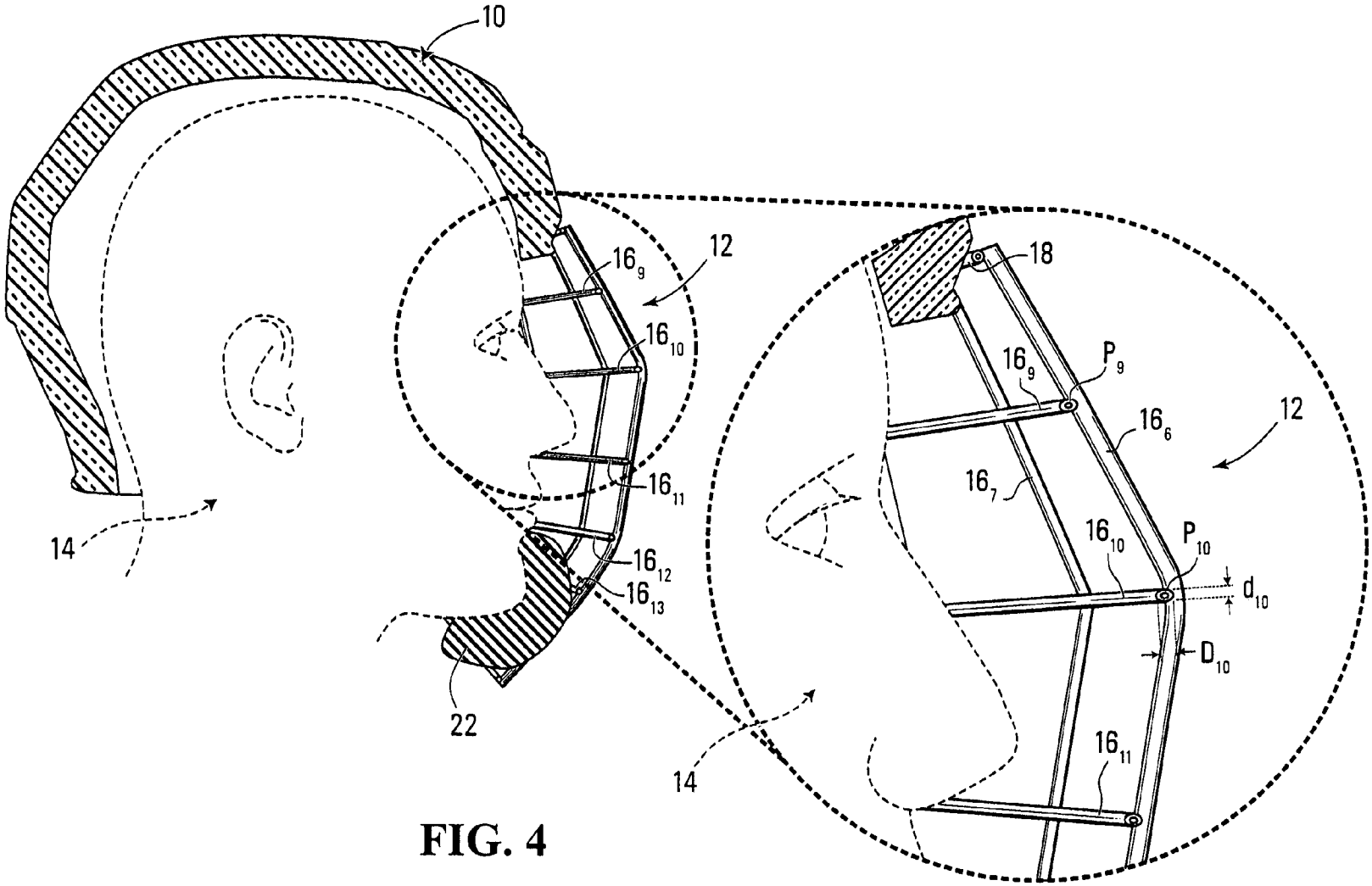
FIG. 4 is a cross-sectional elevational view of the helmet and face guard of FIG. 1, taken along line IV-IV of FIG. 1.
Figure 5:
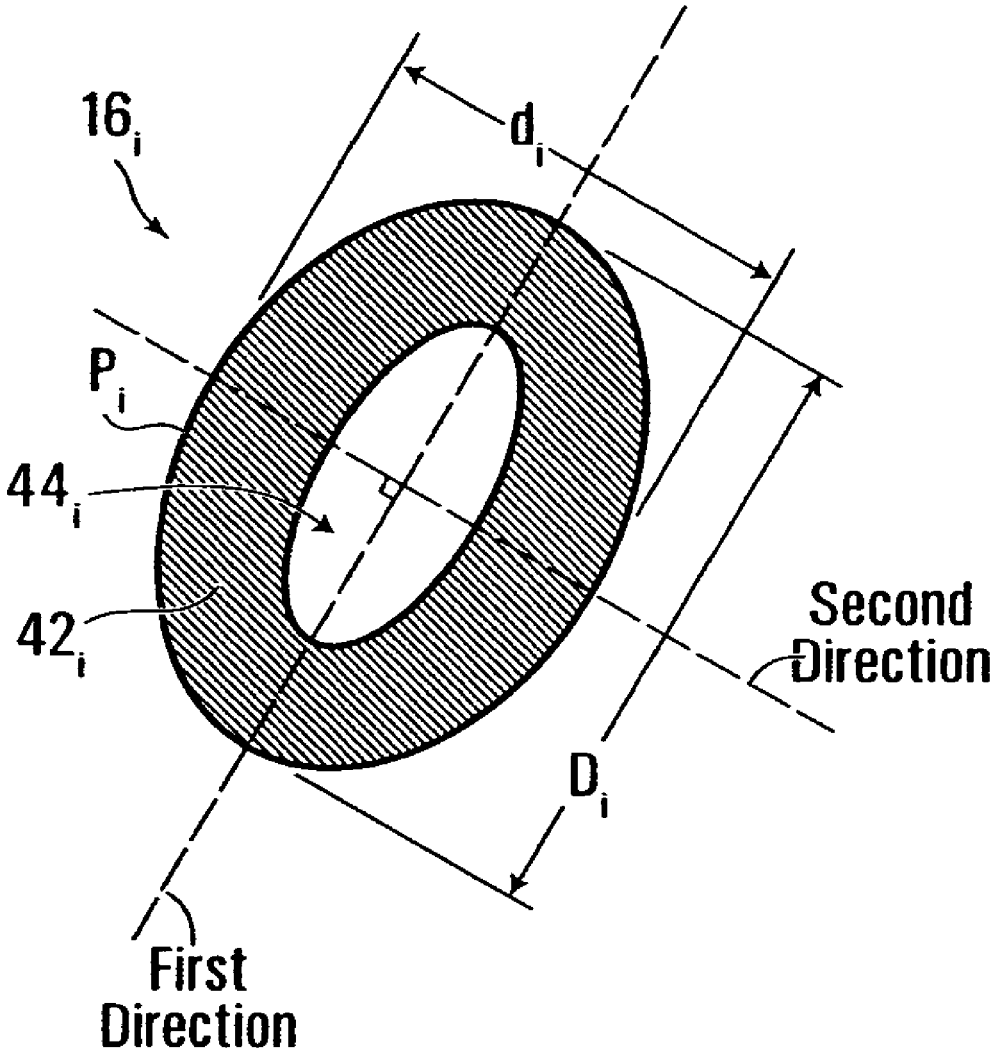
FIG. 5 is a diagrammatic representation of a cross-section of a wire of the face guard of FIG. 1.
Figure 6:
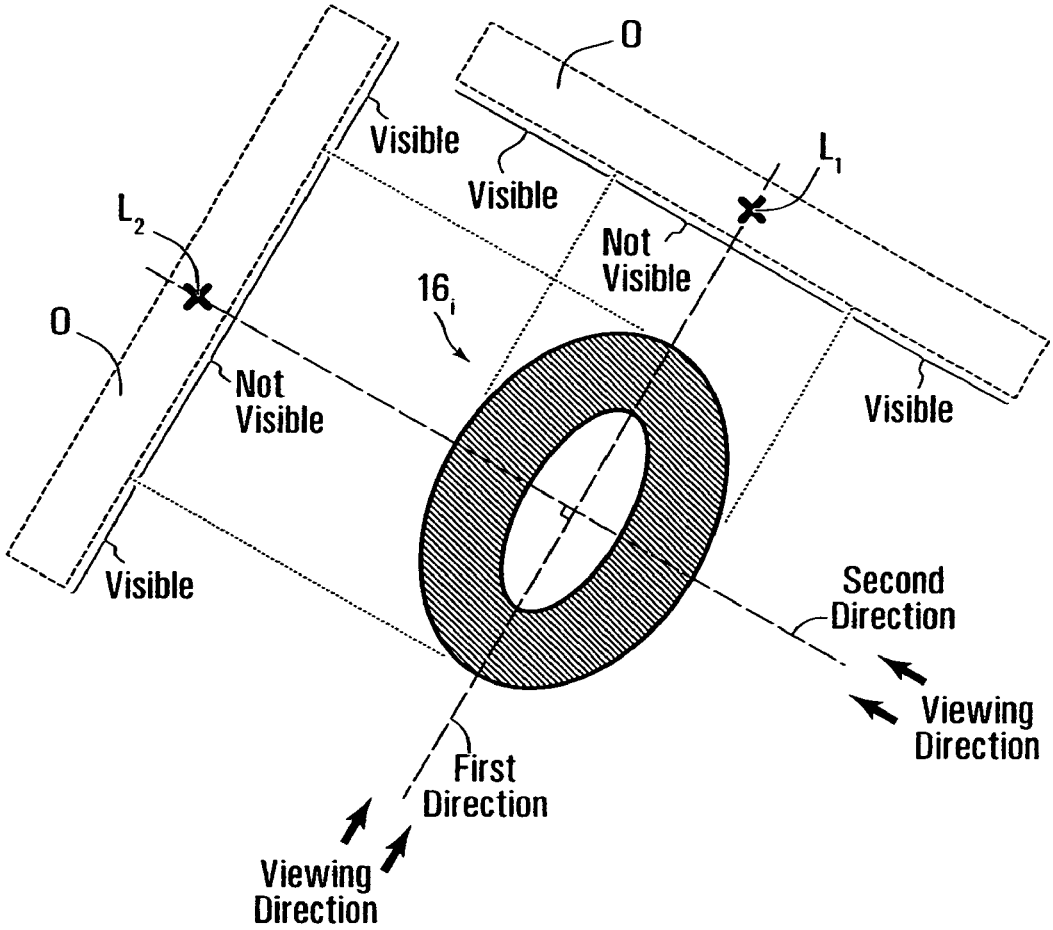
FIG. 6 is a diagrammatic representation illustrating that the wire of FIG. 5 is less obstructive to vision along a first direction than along a second direction.

In contrast, as best seen in FIGS. 3 and 4, and particularly in FIG. 5, each of the wires $\mathbf{16}_3$-$\mathbf{16}_6$ and $\mathbf{16}_9$-$\mathbf{16}_{11}$ has a cross-section with a periphery $P_i$ having a first maximal dimension $D_i$ in a first direction and a second maximal dimension $d_i$ in a second direction intersecting the first direction (where i=3, 4, 5, 6, 9, 10 or 11). In the embodiments, the second direction intersects the first direction at an angle of 90°. It should be understood that the second direction may intersect the first direction at an angle between 70° and 120° depending of the shape of the wire. For a given wire $\mathbf{16}_i$, the second maximal dimension $d_i$ is less than the first maximal dimension $D_i$ such that the given wire $\mathbf{16}_i$ is less obstructive to vision along the first direction than along the second direction. That is, as shown in FIG. 6, if the given wire $\mathbf{16}_i$ is viewed along the first direction and an object O is located at a location $L_1$ behind the given wire $\mathbf{16}_i$ and intersecting the first direction, a greater portion of the object O will be visible than if the given wire $\mathbf{16}_i$ is viewed along the second direction and the object O is located at a location $L_2$ behind the given wire $\mathbf{16}_i$ and intersecting the second direction.

Figure 7A:
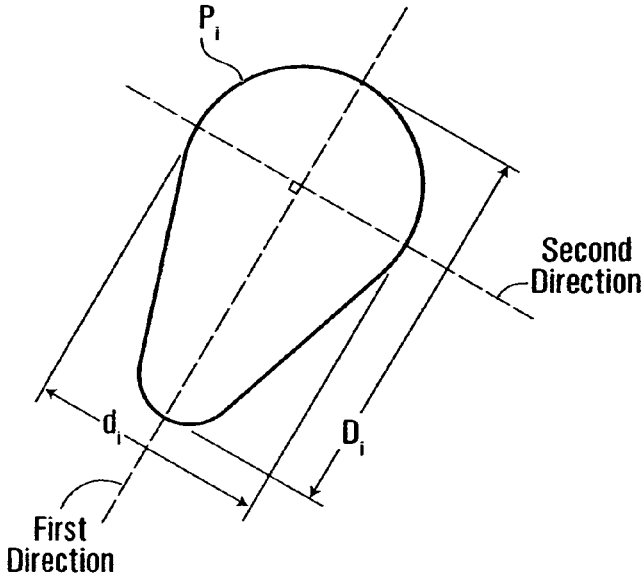
FIGS. 7A to 7C illustrate possible cross-section configurations for a wire of a face guard in accordance with other embodiments of the present invention.
Figure 7B:
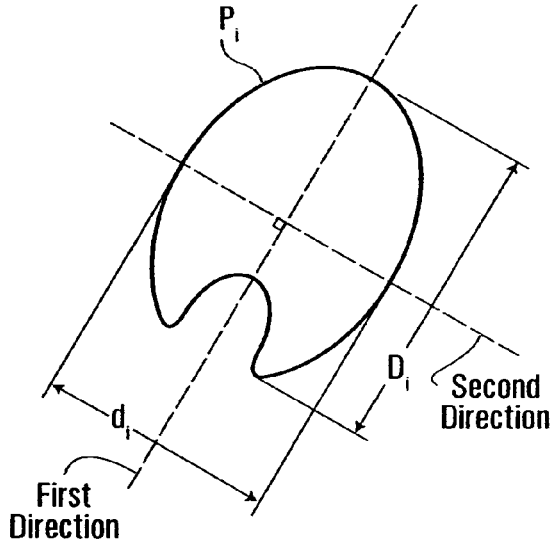
Figure 7C:
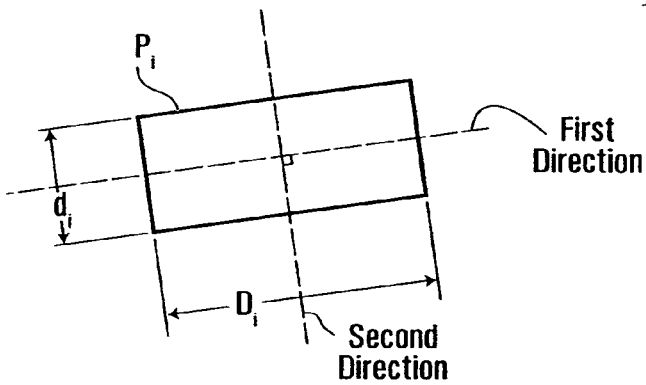

In the embodiment shown in FIGS. 1 to 5, the periphery $P_i$ of a given wire $\mathbf{16}_i$ is an ellipse (i.e. the wire has an elliptical cross-section), the first maximal dimension $D_i$ being the major axis of the ellipse and the second maximal dimension $d_i$ being the minor axis of the ellipse. In other embodiments, the periphery $P_i$ of a given wire $\mathbf{16}_i$ may have various other non-circular configurations. FIGS. 7A to 7C illustrate examples of possible noncircular configurations for the periphery $P_i$ of a given wire $\mathbf{16}_i$, which may be curved or polygonal, as well as the first maximal dimension $D_i$ and the second maximal dimension $d_i$ in each case.

A ratio $d_i/D_i$ between 0.2 and 0.9 has been found advantageous. A ratio $d_i/D_i$ between 0.6 and 0.8 has been found particularly advantageous, with a value of about 0.7 being considered optimal. However, it should be understood that, generally, any ratio $d_i/D_i$ less than one may be envisaged without departing from the scope of the invention.

For convenience, with the periphery $P_i$ of a given wire $\mathbf{16}_i$ being elliptical in the embodiment shown in FIGS. 1 to 5, the first maximal dimension $D_i$ is hereinafter referred to as the major axis $D_i$ of the ellipse and the second maximal dimension $d_i$ is hereinafter referred to as the minor axis $d_i$ of the ellipse. However, as mentioned above, in other embodiments, the periphery $P_i$ of a given wire $\mathbf{16}_i$ may have various other noncircular configurations and it is to be understood that the following description also applies to such embodiments.

Reverting to FIGS. 1 to 4, each of the wires $\mathbf{16}_3$-$\mathbf{16}_6$ and $\mathbf{16}_9$-$\mathbf{16}_{11}$ has an elliptic periphery $P_i$ since it has at least a portion located in a field of view of the wearer 14. To achieve optimal visibility for the wearer 14, the major axis $D_i$ of the periphery $P_i$ of a given wire $\mathbf{16}_i$ may be aligned with a line of sight of the wearer 14 when directly looking at that given wire $\mathbf{16}_i$. However, this may not always be achievable since different wearers may have different lines of sight for the same given wire $\mathbf{16}_i$. Therefore, to accommodate different wearers, the major axes $D_i$ of the wires $\mathbf{16}_3$-$\mathbf{16}_6$ and $\mathbf{16}_9$-$\mathbf{16}_{11}$ may generally be oriented such that they converge toward each other on the concave side of the face guard 12 where the face of the wearer 14 is expected to be located when the wearer 14 wears the face guard 12. While this is not as advantageous as aligning the major axis $D_i$ of the periphery $P_i$ of each given wire $\mathbf{16}_i$ with a line of sight of the wearer 14 when viewing that given wire $\mathbf{16}_i$, it can still be deemed to provide satisfactory results in terms of visibility.

In addition to providing benefits in terms of visibility of the wearer 14, each of the wires $\mathbf{16}_3$-$\mathbf{16}_6$ and $\mathbf{16}_9$-$\mathbf{16}_{11}$ with an elliptic periphery $P_i$ exhibits a rigidity that compares favorably to, and in some cases is better than, that of conventional wires with a circular cross-section. For instance, a wire with an elliptic periphery having a major axis D of 4.0 mm and a minor axis d of 2.8 mm may have a rigidity that is 16% greater than that of a wire with a circular cross-section having the same cross-sectional area and a diameter of 3.35 mm. Such a wire with a circular cross-section may itself be 13% more rigid than a conventional wire with a diameter of 3.2 mm. Thus, it will be appreciated that a wire with an elliptic periphery having a major axis D of 4.0 mm and a minor axis d of 2.8 mm may have a rigidity significantly greater than that of a conventional circular cross-sectioned wire with a diameter of 3.2 mm, in addition to provide benefits in terms of visibility over such conventional wire due to its minor axis being smaller than the diameter of the conventional wire.

Rigidity of a given wire $\mathbf{16}_i$ will be greatest if the major axis $D_i$ of the periphery $P_i$ of the wire $\mathbf{16}_i$ is oriented generally parallel to a direction of an impact force in an impact test, for instance, the direction of an impact force due to impact of a hockey puck. For example, in the particular embodiment shown in FIGS. 1 to 4, the major axis $D_{10}$ of the periphery $P_{10}$ of the wire $\mathbf{16}_{10}$ is oriented in this way.

Enhancements in rigidity exhibited by the wires $\mathbf{16}_3$-$\mathbf{16}_6$ and $\mathbf{16}_9$-$\mathbf{16}_{11}$ with an elliptic periphery $P_i$ result in less severe deformation due to impact of a hockey puck or hockey stick. Advantageously, with less severe deformation of the wires $\mathbf{16}_3$-$\mathbf{16}_6$ and $\mathbf{16}_9$-$\mathbf{16}_{11}$, the face guard 12 may be configured such that the grid defined by the wires $\mathbf{16}_1$-$\mathbf{16}_{13}$ is located closer to the face of the wearer 14 than that of a face guard having conventional wires with a circular cross-section, thereby further improving visibility of the wearer 14.

Furthermore, in the embodiment shown in FIGS. 1 to 5, the wires $\mathbf{16}_1$-$\mathbf{16}_{13}$ are configured to provide benefits in terms of weight of the face guard 12. More specifically, as best seen in FIG. 5, a given wire $\mathbf{16}_i$ has a peripheral wall $\mathbf{42}_i$ defining a hollow interior $\mathbf{44}_i$. Each of the wires $\mathbf{16}_1$, $\mathbf{16}_2$, $\mathbf{16}_7$, $\mathbf{16}_8$, $\mathbf{16}_{12}$ and $\mathbf{16}_{13}$ and the contour wire 18 also has a peripheral wall defining a hollow interior. For instance, in the non-limiting embodiment shown, the major axis $D_i$ may be of 4.0 mm, the minor axis $d_i$ may be of 2.8 mm, and the thickness $t_i$ of the peripheral wall $\mathbf{42}_i$ may be of 0.8 mm. In the case of the wires $\mathbf{16}_1$, $\mathbf{16}_2$, $\mathbf{16}_7$, $\mathbf{16}_8$, $\mathbf{16}_{12}$ and $\mathbf{16}_{13}$ and the contour wire 18 each having a circular periphery, the diameter of the circular periphery may be of 3.2 mm and the thickness of the peripheral wall may be of 1.0 mm.

It will thus be appreciated that the wires $\mathbf{16}_1$-$\mathbf{16}_{13}$ of the face guard 12 are configured and dimensioned so as to provide benefits in terms of visibility to the wearer 14 and weight of the face guard 12, without compromising rigidity and strength for impact resistance.

While in the embodiment shown in FIGS. 1 to 4 only the wires $\mathbf{16}_3$-$\mathbf{16}_6$ and $\mathbf{16}_9$-$\mathbf{16}_{11}$ which have a portion located in the field of view of the wearer 14 have a cross-section with an elliptic periphery, it is to be understood that, in other embodiments, any number of the wires $\mathbf{16}_1$-$\mathbf{16}_{13}$ (including only one or all of the wires $\mathbf{16}_1$-$\mathbf{16}_{13}$) and even the contour wire 18 may have such a cross-section. Furthermore, although in the embodiment shown in FIGS. 1 to 4 the face guard 12 comprises thirteen wires, it is to be understood that, in other embodiments, the face guard 12 may comprise any number of wires without departing from the scope of the invention. Moreover, while in the embodiment shown, each of the wires $\mathbf{16}_1$-$\mathbf{16}_{13}$ has a hollow interior for weight considerations, it is to be understood that, in other embodiments, the wires $\mathbf{16}_1$-$\mathbf{16}_{13}$ are not provided with such a hollow interior.

Although various embodiments have been illustrated, this was for the purpose of describing, but not limiting, the invention. Various modifications will become apparent to those skilled in the art and are within the scope of the present invention, which is defined more particularly by the attached claims.

The invention of claimed is:

1. A face guard for a hockey helmet, comprising a plurality of welded wires made of steel and interconnected to define a curved grid having a concave side for facing a face of a hockey player and having a plurality of apertures, each aperture being sized and configured for preventing a hockey stick or puck from impacting the hockey player's face, said plurality of wires comprising first, second and third vertical wires intersecting fourth, fifth and sixth horizontal wires, each of said first, second, and third vertical wires and fourth, fifth and sixth horizontal wires having a portion to be at least partially located within a field of view of the hockey player wherein, in use, said first, second and third vertical wires and at least one of said fourth, fifth and sixth horizontal wires are located adjacent the eyes of the hockey player for protecting the eyes against impacts from a hockey stick or puck, and each of said first, second, third, fourth, fifth and sixth wires having an elliptical cross-section having a major axis and a minor axis with a ratio of said minor axis to said major axis being between 0.2 and 0.9such that each of said first, second, third, fourth, fifth and sixth wires has a rigidity that is greater than that of a circular wire having the same cross-sectional area as said elliptical wire.

2. A face guard as claimed in claim 1, wherein said ratio is between 0.6 and 0.8 and wherein said rigidity is at least 15% greater.

3. A face guard as claimed in claim 1, wherein at least one of said first, second, third, fourth, fifth and sixth wires has a peripheral wall defining a hollow interior and wherein said peripheral wall has a thickness between 0.5 to 1.0 mm.

4. A face guard as claimed in claim 1, wherein said major axes of said first, second, third, fourth, fifth and sixth wires are oriented such that, in use, they generally converge towards the eyes of the player.

5. A hockey helmet having a face guard as claimed in claim 1.

6. A face guard as defined in claim 1, wherein, in use, each major axis of said first, second, third, fourth, fifth and sixth wires is oriented to generally converge towards the eyes of the player, wherein each of said first, second, third, fourth, fifth and sixth wires has a peripheral wall defining a hollow interior and wherein said peripheral wall has a thickness between 0.5 to 1.0 mm.

7. A face guard for a hockey helmet, comprising a plurality of welded wires made of steel and interconnected to each other via welding to define a curved grid having a concave side for facing a face of a hockey player and having a plurality of apertures, each aperture being sized and configured for preventing a hockey stick or puck from impacting the hockey player's face, said plurality of wires comprising first, second and third vertical wires intersecting fourth, fifth and sixth horizontal wires, each of said first, second and third vertical wires and fourth, fifth and sixth horizontal wires having, a portion to be at least partially located within a field of view of the hockey player wherein, in use, said first, second and third vertical wires and at least one of said fourth, fifth and sixth horizontal wires are located adjacent the eyes of the hockey player for protecting the eyes against impacts from a hockey stick or puck, each of said first, second and third vertical wires and fourth, fifth and sixth horizontal wires having an elliptical cross-section having a major axis and a minor axis with a ratio of said minor axis to said major axis being between 0.6 and 0.9 such that each of said first, second and third vertical wires and fourth, fifth and sixth horizontal wires has a rigidity that is at least 15% greater than that of a circular wire having the same cross-sectional area as said elliptical wire.

8. A face guard as defined in claim 7, wherein, in use, each major axis of said first, second and third vertical wires and fourth, fifth and sixth horizontal wires is oriented to generally converge towards the eyes of the player.

9. A face guard as defined in claim 7, wherein at least one of said first, second, third vertical wires and fourth, fifth and sixth horizontal wires has a peripheral wall defining a hollow interior and wherein said peripheral wall has a thickness between 0.5 to 1.0 mm.

10. A hockey helmet having a face guard as defined in claim 7.

11. A face guard for a hockey helmet, comprising a plurality of welded wires made of steel and interconnected to each other via welding to define a curved grid having a concave side for facing a face of a hockey player and having a plurality of apertures, each aperture being sized and configured for preventing a hockey stick or puck from impacting the hockey player's face, said plurality of wires comprising first, second and third vertical wires intersecting fourth, fifth and sixth horizontal wires, each of said first, second and third vertical wires and fourth, fifth and sixth horizontal wires having a portion to be at least partially located within a field of view of the hockey player wherein, in use, said first, second and third vertical wires and at least one of said fourth, fifth and sixth horizontal wires are located adjacent the eyes of the hockey player for protecting the eyes against impacts from a hockey stick or puck, each of said first, second and third vertical wires and fourth, fifth and sixth horizontal wires having an elliptical cross-section having a major axis and a minor axis with a ratio of said minor axis to said major axis being between 0.6 and 0.9, and wherein each of said first, second, third vertical wires and fourth, fifth and sixth horizontal wires has a peripheral wall defining a hollow interior.

12. A face guard as defined in claim 11, wherein said peripheral wall has a thickness between 0.5 to 1.0 mm.

13. A face guard as defined in claim 11, wherein each of said first, second and third vertical wires and fourth, fifth and sixth horizontal wires has. a rigidity that is greater than that of a circular wire having the same cross-sectional area as said elliptical wire.

* * * * *

UNITED STATES PATENT AND TRADEMARK OFFICE

CERTIFICATE OF CORRECTION

PATENT NO. : 7,765,608 B2
APPLICATION NO. : 11/211668
DATED : August 3, 2010
INVENTOR(S) : Jacques Durocher et al.

It is certified that error appears in the above-identified patent and that said Letters Patent is hereby corrected as shown below:

Col. 5, in claim 1, on line 36, add a space between "0.9" and "such"

Col. 5, in claim 7, starting at the end of line 61, remove "each other via welding to"

Col. 6, in claim 11, starting at the end of line 33, remove "each other via welding to"

Col. 6, in claim 13, on line 58, remove the period between "wires has" and "a rigidity"

Signed and Sealed this

Seventh Day of September, 2010

David J. Kappos

David J. Kappos
*Director of the United States Patent and Trademark Office*